US005749280A

United States Patent [19]

Scherzinger

[11] Patent Number: 5,749,280

[45] Date of Patent: May 12, 1998

[54] CIRCULAR BRAIDING MACHINE WITH INNER AND OUTER SPOOLS ARRANGED ON CIRCULAR TRACK

[75] Inventor: Werner Scherzinger, Bisingen, Germany

[73] Assignee: Sipra Patententwicklungs- U. Beteiligungsgesellschaft MBH, Albstadt, Germany

[21] Appl. No.: 496,395

[22] Filed: Jun. 29, 1995

[30] Foreign Application Priority Data

Jun. 30, 1994 [DE] Germany ..... 44 22 893.7

[51] Int. Cl.[6] ..... D04C 3/48

[52] U.S. Cl. ..... 87/48; 87/44; 87/45

[58] Field of Search ..... 87/48, 35, 44, 87/45

[56] References Cited

U.S. PATENT DOCUMENTS

| | | | |
|---|---|---|---|
| 814,711 | 3/1906 | Larsson | 87/45 |
| 1,260,063 | 3/1918 | Rosskothen | 87/44 |
| 1,456,656 | 5/1923 | Tober | 87/44 |
| 1,457,474 | 6/1923 | Tober | 87/44 |
| 1,615,587 | 1/1927 | Klein et al. | 87/44 |
| 4,372,191 | 2/1983 | Iannuci et al. | 87/48 |
| 4,729,278 | 3/1988 | Graeff et al. | 87/48 |
| 5,099,744 | 3/1992 | Hurst et al. | 87/45 |

FOREIGN PATENT DOCUMENTS

| | | |
|---|---|---|
| 0441604 | 8/1991 | European Pat. Off. . |
| 2743893 | 9/1977 | Germany . |
| 3937334 | 7/1990 | Germany . |
| 4009494 | 6/1991 | Germany . |
| 2062022 | 10/1980 | United Kingdom . |
| 241239 | 10/1980 | United Kingdom . |
| 2238798 | 8/1990 | United Kingdom . |

*Primary Examiner*—William Stryjewski
*Attorney, Agent, or Firm*—Michael J. Striker

[57] ABSTRACT

The invention relates to a circular braiding machine with two groups of spools (31, 38) circulating about an axis of rotation (1) on a circular path in opposite directions of rotation, the spools carrying strands (32, 37) for braiding a braided material (36) at a braiding point (35). In order to cross the strands (32, 37) in the manner characteristic of the braid (e.g. "2 over–2 under") there serve strand guide members (48) which are mounted to reciprocate on guide tracks (49) arranged substantially radially relative to the axis of rotation (1), as well as levers (50) which are arranged substantially in the extensions of the guide tracks (49) and are articulated in the manner of connecting rods at one end to the strand guide members (48) and at the other end to rotating crank levers (52).

18 Claims, 13 Drawing Sheets

CIRCULAR BRAIDING MACHINE WITH INNER AND OUTER SPOOLS ARRANGED ON CIRCULAR TRACK

BACKGROUND OF THE INVENTION

This invention relates to a circular braiding machine which comprises an axis of rotation, a group each of inner and outer spools arranged on a circular track coaxial with the axis of rotation and each carrying a strand, drive means for moving the groups of spools in opposite directions, strand guide members for guiding at least the strands of one of the groups of spools at a location between the latter and a braiding point, and means with levers operating synchronously with the drive means and being coupled to the strand guide members for crossing the strands of the inner and outer spools.

Braiding machines are known in two main kinds. In one kind, predominantly used in the past, the spool carriers themselves execute their movement in crossing paths needed for the interlacing or cross-overs of the threads or strands (maypole principle). However, the other kind is used predomiantly today, in which the two groups of spools execute circular movements in opposite senses and only the strands of one group are passed alternately over and under the spools of the other group (high-speed braiding principle). The invention is concerned only with the second kind of circular braiding machine as mentioned above.

There are various systems for the to and fro movement of the strands.

The greatest number of known circular braiding machines operate with swinging levers which are pivotally mounted at one end and have strand guide members at the front end and are moved to and fro with the aid of cranks, eccentrics or control camways (e.g. DE-PS 2 743 893, EP 0 441 604 A1). The strand guide members then perform a substantially sinusoidal movement. This results in a whip-like to and fro swinging of the swinging lever at high speeds of rotation of the circulating spool groups, which leads to high bending stresses and thus to overswing of the swinging lever at the points of reversal and is problematic for constructional reasons (e.g. high wear). Moreover the sinusoidal course of movement has the result that the number of spools which can be fitted round the circumference of the machine has to be comparatively smaller or the spacing between the spools has to be made comparatively greater, if instead of a simple "1 over–1 under" crossing (or braid configuration) a higher order such as a "2 over–2 under", "3 over–3 under" braid configuration or the like is to be provided, because sinusoidal curves run comparatively flat in the crossover region. This disadvantage can it is true be avoided in part if the swinging movement of the swinging lever is accelerated in the crossover regions and retarded in the regions of reversal compared with a pure sinusoidal movement (DE 3 937 334 A1), with the aid of a drive linkage coupled to a crank arm. The whip effect and the constructional problems associated therewith can however only be reduced to a small extent by this.

In order to avoid the whip effect it is already known to arrange the strand guide member at one end of a constantly rotating crank slide linkage and so to control the circulating movement of the crank slide linkage that the strand guide member describes the path of a coiled epicycloid (DE 4 009 494 A1). The result of this is that the crank slide linkage with the strand guide member has the greatest angular velocity in the crossover operation but only moves very slowly or is held nearly stationary in between two crossovers, in order to be able also to carry out braid configurations of "2 over–2 under" in this way. However in this solution also the course of the curve in the crossover region is in part relatively flat, so that the spool spacing has to be comparatively large and "2 over–2 under" patterns and higher value patterns cannot be carried out sufficiently economically. Apart from this there is the danger that the individual strands twist up or twist together, especially when the strands are treated, sticky material.

SUMMARY OF THE INVENTION

In the light of this it is one important object of this invention to so design the circular braiding machine of the kind initially referred to that whip-like movements of the parts moving the strand guide members are largely avoided.

A further object of this invention is to design the braiding machine such that comparatively small spool spacings can be realised even if whip-like movements are largely avoided.

Yet another object of the invention is to make possible braid patterns up to "3 over–3 under" or even higher value patterns under economic conditions.

These and other objects of the invention are solved by a braiding machine which is characterized in that the strand guide members are mounted to reciprocate in guide tracks arranged substantially radially relative to the axis of rotation, and in that the levers are arranged substantially in the extension of the guide tracks and are articulated in the manner of connecting rods at one end to the strand guide members and at the other end to respective rotating crank levers.

Further advantageous features of the invention appear from the dependent claims.

BRIEF DESCRIPTION OF DRAWING

The invention will be explained in more detail below in conjunction with the accompanying drawings of non-limiting embodiments, in which.

DESCRIPTION OF PREFERRED EMBODIMENTS

Figure 1:
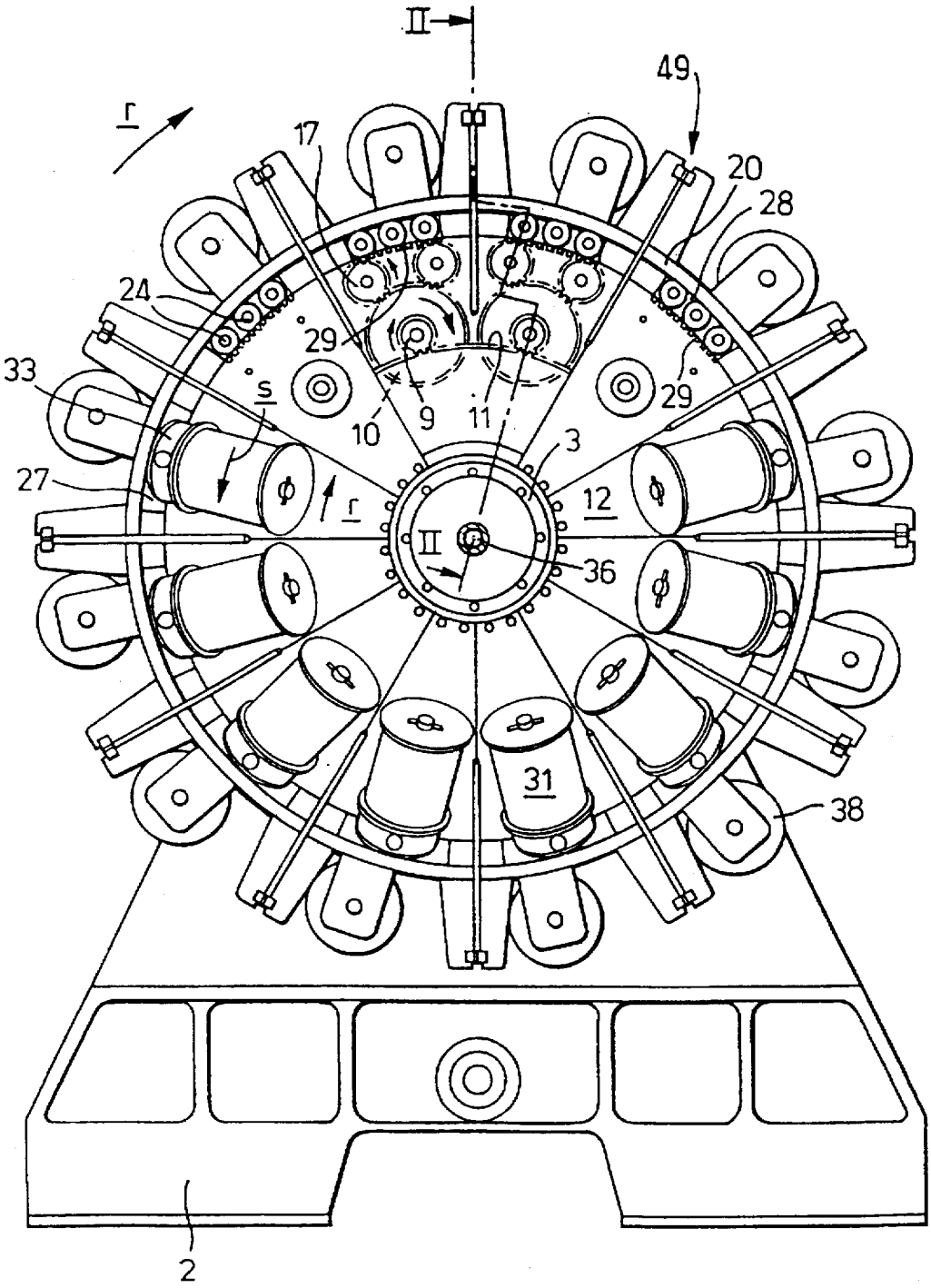
FIG. 1 is a partailly broken away front view of a circular braiding machine according to the invention.
Figure 2:
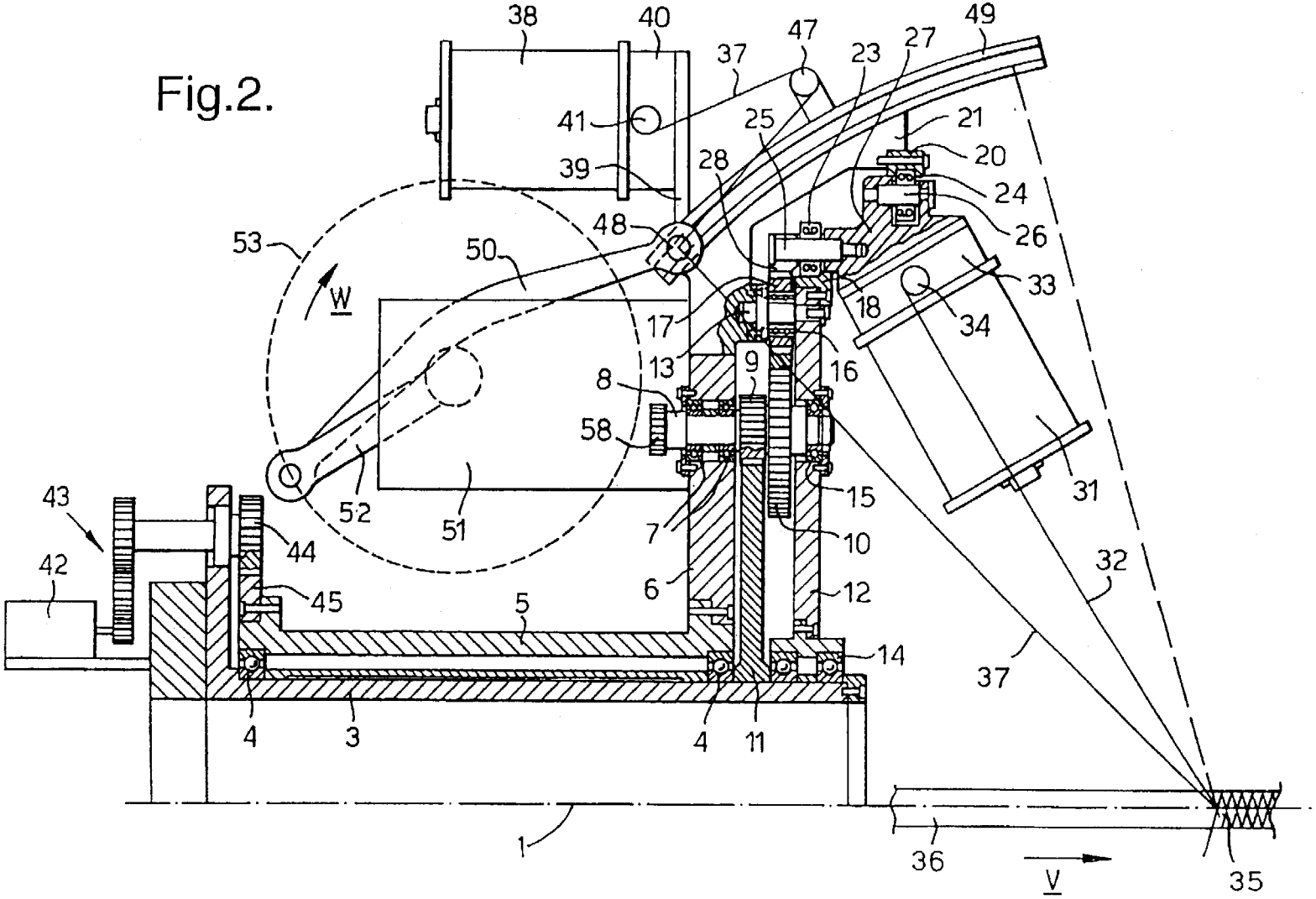
FIG. 2 is a vertical section approximately along the line II—II in FIG. 1 through the upper half of the circular braiding machine, to a larger scale.

FIGS. 1 and 2 show a circular braiding machine as an example with a horizontally arranged axis of rotation 1 (FIG. 2). A rotor support 3 (FIG. 2) is fixed on a base frame 2 and a hub 5 is mounted thereon, rotatable about the axis of rotation 1, by means of bearing units 4. The hub 5 carries an annular, substantially circular and vertically arranged rotor 6. A plurality of bearing units 7 are fitted in this at a constant radial distance from the axis of rotation 1 and distributed at equal angular spacings about the axis of rotation, shafts 8 being rotatably mounted parallel to the axis of rotation 1 in these bearing units. A pinion 9 and then a gearwheel 10 are mounted axially behind one another on the front ends of these shafts 8. Each pinion 9 meshes with a stationary gearwheel 11 which is arranged in front of the rotor 6, coaxial with the axis of rotation 1. On rotation of the rotor 6, the pinion 9 rolls like a planetary gear on the gearwheel 11 acting as a sun gear.

The rotor 6 further carries a support 12 which is likewise substantially annular and circular, is additionally mounted rotatably on the rotor support 3 by means of bearing units 14 on the inside and is fixed on the rotor 6 in front of the gearwheel 10 by means of pins 13 lying radially outside the shafts 8 and parallel thereto. The support 12 further supports the front ends of the shafts 8 by means of further bearing units 15. In between the rotor 6 and the support 12 intermediate pinions 17 are mounted rotatably on the pins 13 by means of bearing units 16 and are in mesh with the gearwheels 10. As FIG. 1 in particular shows, there are twelve shafts 8 with pinions 9 and gearwheels 10 in the embodiment, arranged about the axis of rotation 1, while two intermediate pinions 17 are associated with each gearwheel 10 with their pins 13 lying on a circle coaxial with the axis of rotation 1.

Uniformly spaced segments 18 are fixed on the outer periphery of the support 12 and roller tracks, e.g. of groove form, are formed therein, being open radially outwardly, i.e. upwardly in FIG. 2. Corresponding segments 20 are fixed on the rotor 6 by means of spaced support brackets 21 and roller tracks, e.g. likewise of groove form, are formed therein, being open radially inwardly, i.e. downwardly in FIG. 2. Moreover the segments 20 are arranged axially in front of the segments 18 and at greater radial spacings from the axis of rotation 1 than the segments 18.

The roller tracks of the segments 18, 20 serve to receive rollers 23 and 24 respectively, which are mounted rotatably on bearing pins 25 and 26 respectively with axes parallel to the axis of rotation 1. These pins 25, 26 are fixed to spool carriers 27, which like the segments 18, 20 are distributed at uniform intervals around the axis of rotation 1. In addition, ring sections 28 with internal teeth 29 (FIG. 1) are fixed on the pins 25 and mesh with the intermediate pinions 17. The ring sections 28, considered in the circumferential direction of the rotor 6, have such a length that each ring section 28 is always in engagement with at least one of the intermediate pinions 17 during rotation relative to the rotor 6, independent of its instantaneous position, while there is nevertheless radial free space or slots between the individual ring sections 28. The rollers 23, 24 are correspondingly so fitted on the spool carriers 27 that each spool carrier 27 is always guided positively in each segment 18, 20 by at least two rollers 23, 24 during rotation relative to the rotor 6, independently of its instantaneous position, while there are nevertheless slots or radial free spaces between the individual spool carriers. Both the roller tracks of the segments 18, 20 and the teeth 29 lie on circles coaxial with the axis of rotation 1.

The spool carriers 27 carry a first group of front or inner spools 31, from each which a thread (wire) or strand 32 is guided to a braiding point 35 over a roller 34 controlled by a tension regulator 33; at the braiding point the braided material 36 is braided as it is transported in the direction of the axis of rotation 1 (arrow v in FIG. 2).

Further threads or strands 37 are fed from a second group of rear or outer spools 38, which are fixed by holders 39 on the brackets 21 and are also fed to the braiding point 35 over rollers 41 controlled by tension regulators 40. In accordance with FIG. 1 there are as an example twelve each of the front and rear spools 31 and 38 respectively.

The drive of the circular braiding machine is effected by a drive motor 42 mounted in the base frame 2 and driving a drive pinion 44 through gearing 43, the pinion meshing with a gearwheel 45 fixed on the hub 5.

Switching on the drive motor 42 results in the hub 5 and the rotor 6, the support 12, the segments 18 and 20 and the rear spools 38 rotating in a selected direction, e.g. clockwise, as is indicated in FIG. 1 by an arrow r. The pinions 9 roll on the periphery of the gearwheel 11 so that both these and also the gearwheels 10 are turned clockwise. As against this the intermediate pinions are driven anticlockwise. By suitably dimensioning the various gearwheels or pinions the rotation of the intermediate pinions 17 is effected at such a high speed that the teeth 29 in engagement therewith and the spool carriers 27 and the spools 31 are moved in the roller tracks of the segments 18, 20 in the anticlockwise direction (arrow s in FIG. 1), moreover with the same angular speed as the rotor 6 but in the opposite sense.

In order to wind on the braided material 36 in the manner characteristic of the braiding, with crossing strands 32, 37, the strands of one group of spools must be moved to and fro periodically between the spools of the other group. As a rule it is the strands 37 of the rear spools 38 which are moved through between the front spools 31, for which slots or free spaces of adequate size have to be present at least during the crossover movement not only between the front spools 31 but also between the parts supporting them, these slots or free spaces being provided in the embodiment for example between the segments 18, 20 and spool carriers 27 and also between the brackets 21 or in the rotor 6 and possibly in the support 12.

Circular braiding machines of this kind are generally known to the man skilled in the art and do not therefore need to be explained in more detail. As a precaution, reference is made to the publications cited initially, their content hereby being made part of the present disclosure.

In the embodiment the strands 37 of the rear spools 38 are periodically moved through between the front spools 31. To this end the strand 37 from each spool 38 is fed firstly over a deflecting roller 47 and thence through a strand guide member 48, for example an eye, to the braiding point 35 and the strand guide member 48 is guided according to FIG. 2 on a curved guide track 49, but equally on a linear guide track, and is reciprocated by a respective lever 50 which is driven from a drive unit 51. A curved guide track 49 makes it possible to keep the distance from the strand guide member 48 to the braiding point 35 substantially constant over its whole path of movement. It is essential in this that each lever 50 is arranged substantially in the extension of the guide track 49 at the two points or reversal of the associated strand guide member 48, i.e. when this reaches the ends of the guide track 49. This is shown in FIG. 2 for the position of the lever 50 shown in full lines. The lever 50 will thus always be stressed in tension or compression, but not by a bending stress, at the points of reversal, so that even at high working speeds, no significant overshoots or vibrations can arise, such as are unavoidable with known circular braiding machines on account of the whip effect. The lever 50 is preferably further so moved that it always makes an acute angle, substantially different from 90°, with the guide track 49 or the current tangent thereto in all position of the strand guide member 48, i.e. in the intermediate positions also it is subjected to bending stresses only slightly. Finally the end of the lever 50 remote from the strand guide member 48 is also at no time reciprocated abruptly but in accordance with FIG. 2 is guided by means of a crank lever 42 round a circular path 53 (arrow w), so that mechanical stresses of the whole strand guide system are largely avoided, even at high working speeds. All these advantages are obtained without it being necessary to move the strand guide member 48 itself on a circulating path, so that twisting of the individual strands is not possible.

Figure 3:
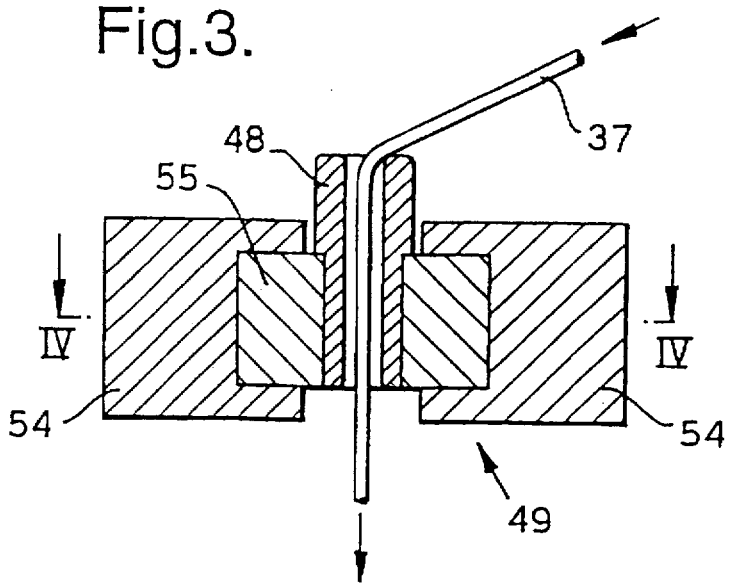
FIG. 3 is front view of a guide track of the circular braiding machine, greatly enlarged, as seen from the right in FIG. 2.

Each guide track 49 is, as shown by FIGS. 1 and 2, arranged substantially radially and preferably at such an acute angle to the axis of rotation 1 that the spacing of the strand guide member 48 from the braiding point 35 only alters slightly during the to and fro movement along the guide track 49. The guide track 49 advantageously comprises, according to FIGS. 3 and 4, two substantially U-shaped rails 54, whose open sides face each other, with a spacing therebetween, and between which a sliding fit carriage 55 is movably guided with the aid of rollers or the like. This has the strand guide member 48 at its front end, formed e.g. as an eye and so arranged that the strand 37 from the associated spool 38 (FIG. 2) is fed in the arrowed direction (FIG. 3) between the two rails 54 to the braiding point 35, without coming into contact with the rails 54 or other parts of the guide track 49 during the to and fro movement of the carriage 55. At the rear end the carriage is articulated to the lever 50 (cf. also FIG. 2) by means of a bearing unit 56, the lever lying substantially in a conceptual rearward extension of the path of movement formed by the two rails 54, at least at the two points of reversal of the carriage 55 on the guide track 49.

Figure 2A:
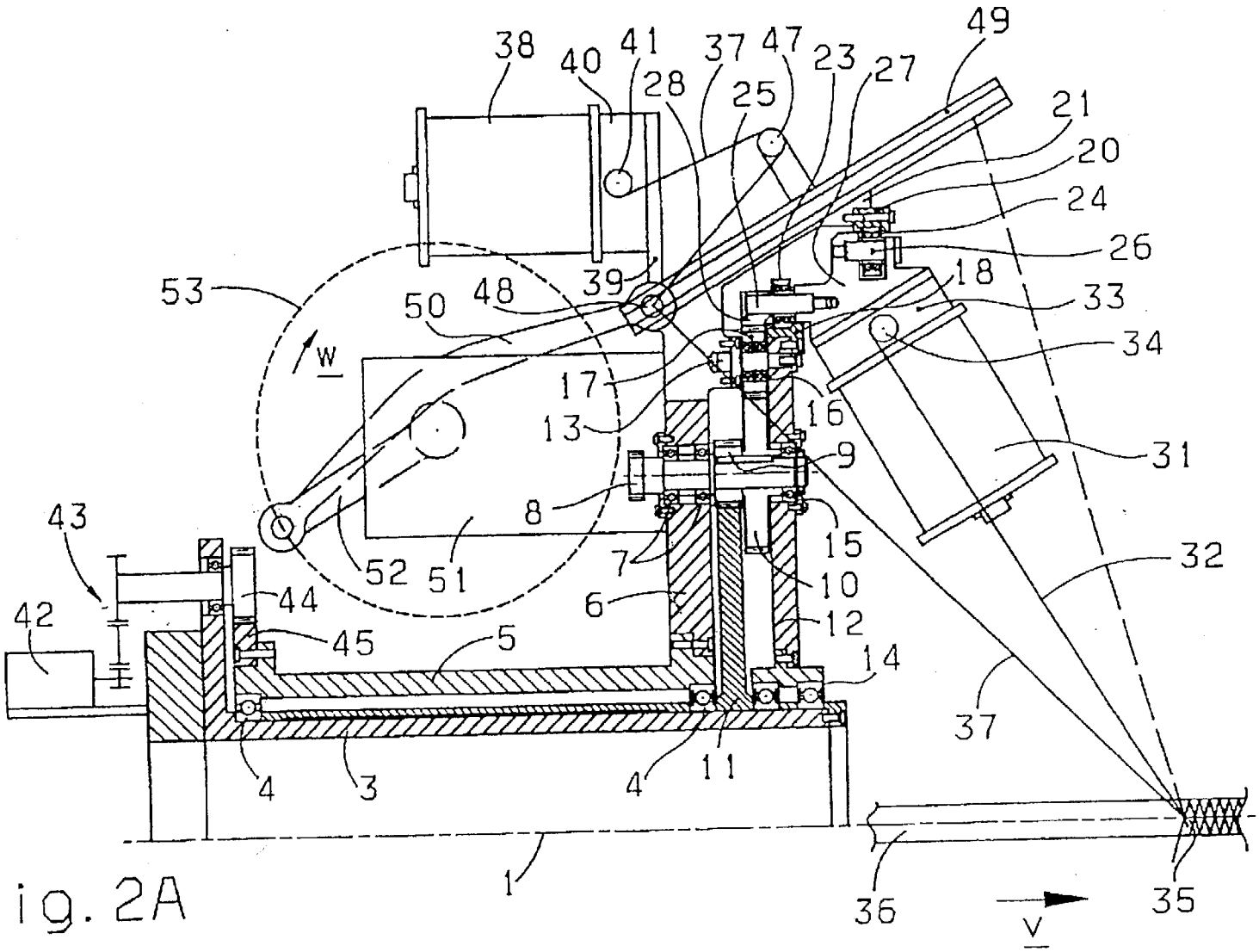
FIG. 2*a* is a section according to FIG. 2 through a further embodiment of the braiding machine.

FIG. 2*a* shows a shows guide tracks 49*a* that are in a linear form.

The drive unit 51 can be implemented in various ways and is so designed in an advantageous development of the invention that the speed of the strand guide member 48 at the ends of the guide track 49 is smaller and in the middle part of the guide track 49 is greater than that which would be the case with a pure sinusoidal movement.

FIGS. 5 to 9 show an embodiment of the invention using a special eccentric drive unit as the drive unit 51 according to FIG. 2. Each drive unit 51 includes a drive unit housing 57 (FIGS. 5, 6), which is screwed on to the rotor 6 and receives a drive gearwheel 58 which is also shown in FIG. 2 and is fixed on the end of the respective shaft 8 remote from the support 12. The drive gearwheel 58 drives a shaft 60 through a gearwheel 59 fixed thereon, the shaft being mounted rotatably in the drive unit housing 57 by bearing units 61 and carrying a bevel gear at its end remote from the gearwheel 59. The bevel gear 62 meshes with a bevel gear 63, which is fixed by a key 64 (FIG. 6) on a shaft 65 rotatably mounted in the drive unit housing 57. A further gearwheel 66 is fixed on the shaft 65 by the same key 64, on the end remote from the bevel gear 63, and meshes with an intermediate gearwheel 67, which is on a shaft 68 spaced from and parallel to the shaft 65 and mounted rotatably in the drive unit housing 57 and is for its part in mesh with a gearwheel 69, which is fixed on a further shaft 70, which is mounted in the drive unit housing 57 spaced from and parallel to the shaft 65. This shaft 70 carries a second gearwheel 71, which meshes with a gearwheel 72 which is mounted rotatably on the shaft 65 on the side of the gearwheel 66 remote from the bevel gear 63. The gearwheels 66, 67, 69, 71 and 72 are preferably spur gears, bearing units 73 to 77 being provided to support them and journal them stably.

A circular disc 78 is fixed on an end of the shaft 65 remote from the bevel gear 63 and can be recessed into the gearwheel 72 and is provided with an eccentrically located cam roller 79, which projects axially beyond the circular disc 78 and the gearwheel 72. In corresponding manner a bearing pin 80 with an axially projecting, circular guide head 81 is provided in the gearwheel 72, parallel to the axis of the cam roller 79, spaced therefrom and also eccentrically arranged.

Figure 7:
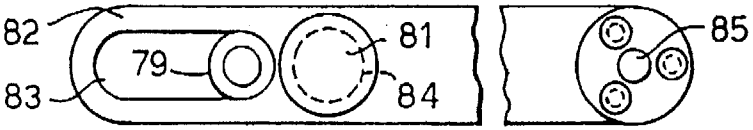
FIG. 7 is a view of a lever driven by the drive unit according to FIGS. 5 and 6 in the direction of an arrow x in FIG. 6.
Figure 8A:
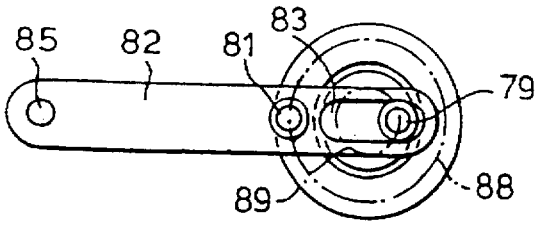
FIGS. 8A, 8B, 8C, 8D, 8E show various positions of the lever according to FIG. 7 schematically, during the operation of the circular braiding machine according to FIGS. 1 and 2.
Figure 8B:
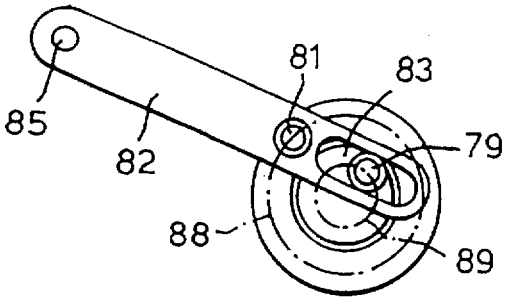
Figure 8C:
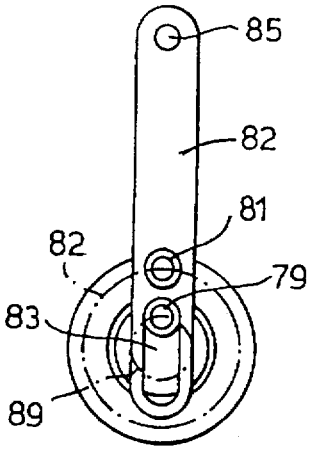
Figure 8D:
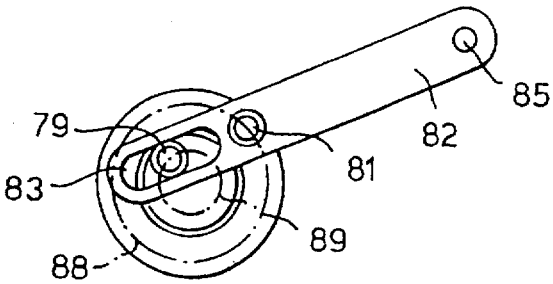
Figure 8E:
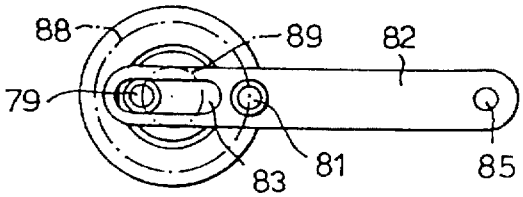

A crank lever 82 is mounted on the free face of the gearwheel 72 and of the circular disc 78 and comprises according to FIG. 7 a slot 83 running parallel to its longitudinal axis at its rear end, with a circular opening 84 in its middle section, and a bearing pin 85 at its front end, with a bearing element 86. The crank lever 82 is mounted slidably and rotatably perpendicular to the axis 87 of the shaft 65 with the cam roller 79 projecting into the slot and the guide head 81 into the opening 84. The bearing element 86 is moreover arranged in a corresponding circular receptacle in the lever 50 (FIG. 2), which is thus rotatably mounted on the crank lever 82 and can also be designated a connecting rod.

Figure 5:
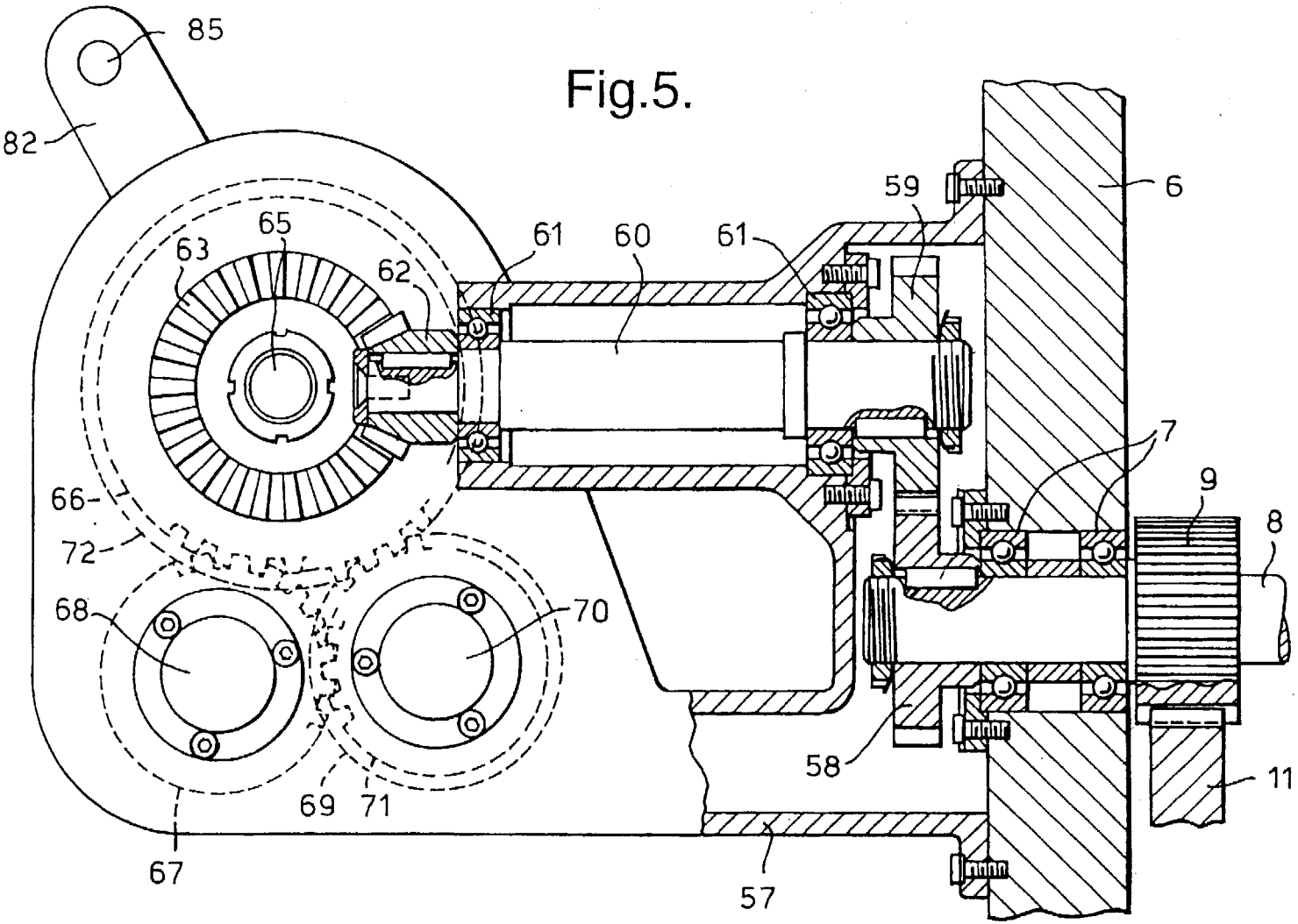
FIG. 5 is a vertical section similar to that of FIG. 2 through a first embodiment, shown to a larger scale of a drive unit of the circular braiding machine according to FIGS. 1 and 2, for driving a strand guide member.
Figure 6:
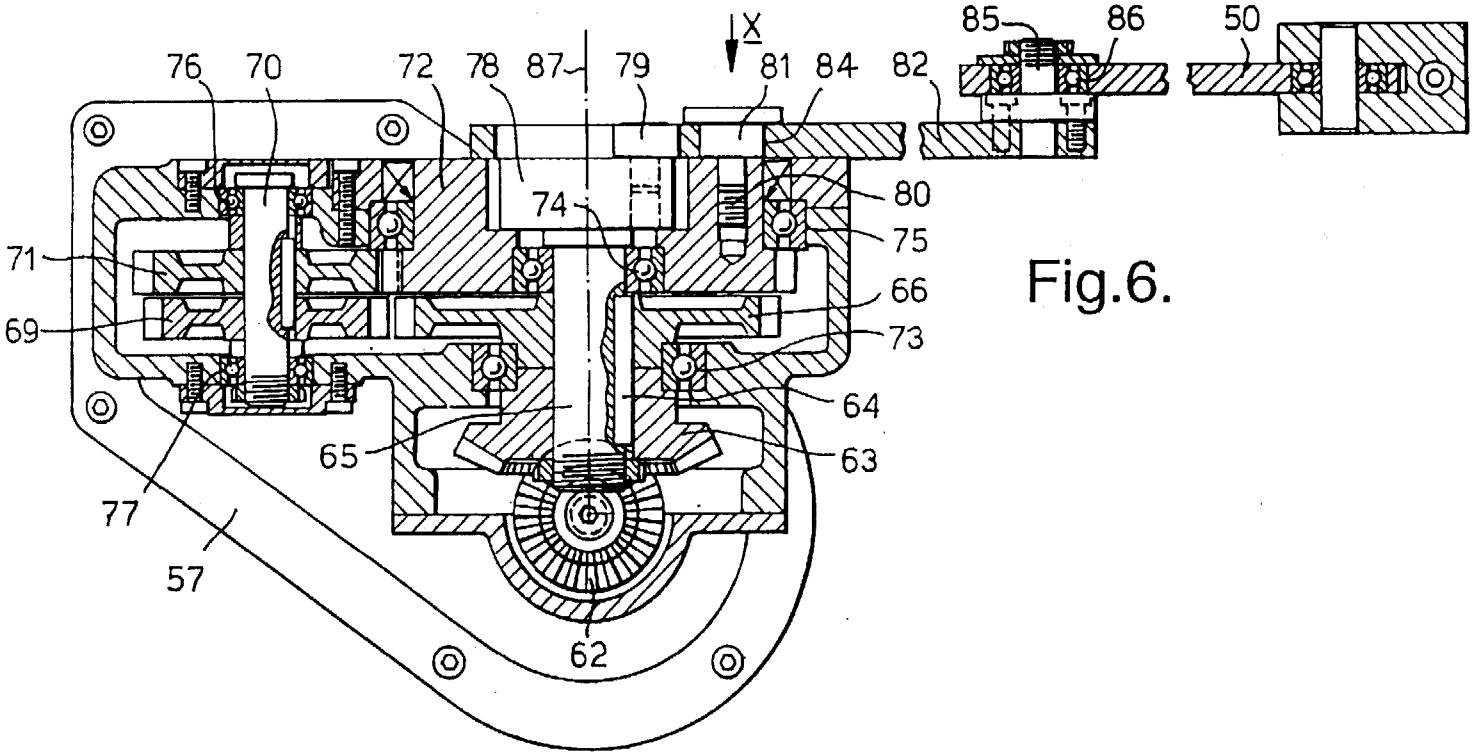
FIG. 6 is a plan view of the drive unit according to FIG. 5.

The manner of operation of the drive unit according to FIGS. 5 to 7 is shown schematically in FIG. 8. Since the gearwheels 66 and 69 (FIG. 6) are coupled by an intermediate gearwheel 67, drive imparted from the gearwheel 58 in synchronism with the rotation of the rotor 6 to the bevel gear 63 in anticlockwise sense results in clockwise rotation of the gearwheel 72, i.e. the cam roller 59 and the guide head 81 run in opposite senses of rotation about the axis 87 (FIG. 6). The transmission ratios of the various gearwheels are so selected that the cam roller 79 and the guide head 81 turn oppositely with the ratio 1:1.

The position A in FIG. 8 is that position which corresponds to the left dead point of the lever 50 in FIG. 2. It is assumed that the guide head 81 in FIGS. 6 and 7 is arranged in this position fully to the left and the cam roller 79 fully to the right in the slot 83 and that the guide head 81 and the cam roller 79 rotate respectively clockwise about a circular path 88 and anticlockwise about a circular path 89 which has a smaller radius than the circular path 88. After rotation of the cam roller 79 and the guide head 81 through about 45° each (position B), the crank lever 82 has turned through an angle in the clockwise sense which is substantially smaller than 45° and amount to about 25° for example. After a further rotation of the cam roller 79 and the guide head 81 through 45°, the crank lever 82 is in the 90° position (position C), which means that it has turned through substantially more than 45°, e.g. through 65°. In its further course (position D) the crank lever 82 turns again through about 65° in comparison with a 45° rotation of the cam roller 79 and the guide head 81, until after they have rotated through 180° in total (position E), the crank lever 82 also assumes the 180° position, which would correspond in FIG. 4 to the right dead point of the lever 50 or of the corresponding strand guide member 48. Commencing from the position E, the crank lever 82 then turns in the same direction and with corresponding accelerations and retardations through a further 180°, until it assumes the starting position (position A) again. This means that the bearing pin 85, if the crank lever 82 is used in place of the crank lever 52 in FIG. 2, does not pass round the circular path 53 with constant angular velocity, but the lever 50 accelerates in between the points of reversal of the guide track 49 substantially faster than in the region of the points of reversal. In this way, not only is the whip effect avoided, but operation altogether less subject to wear is facilitated, even at high speeds of rotation, because of the movement of the crank lever 82 and of the bearing pin 85 take place in one direction only.

Figure 9:
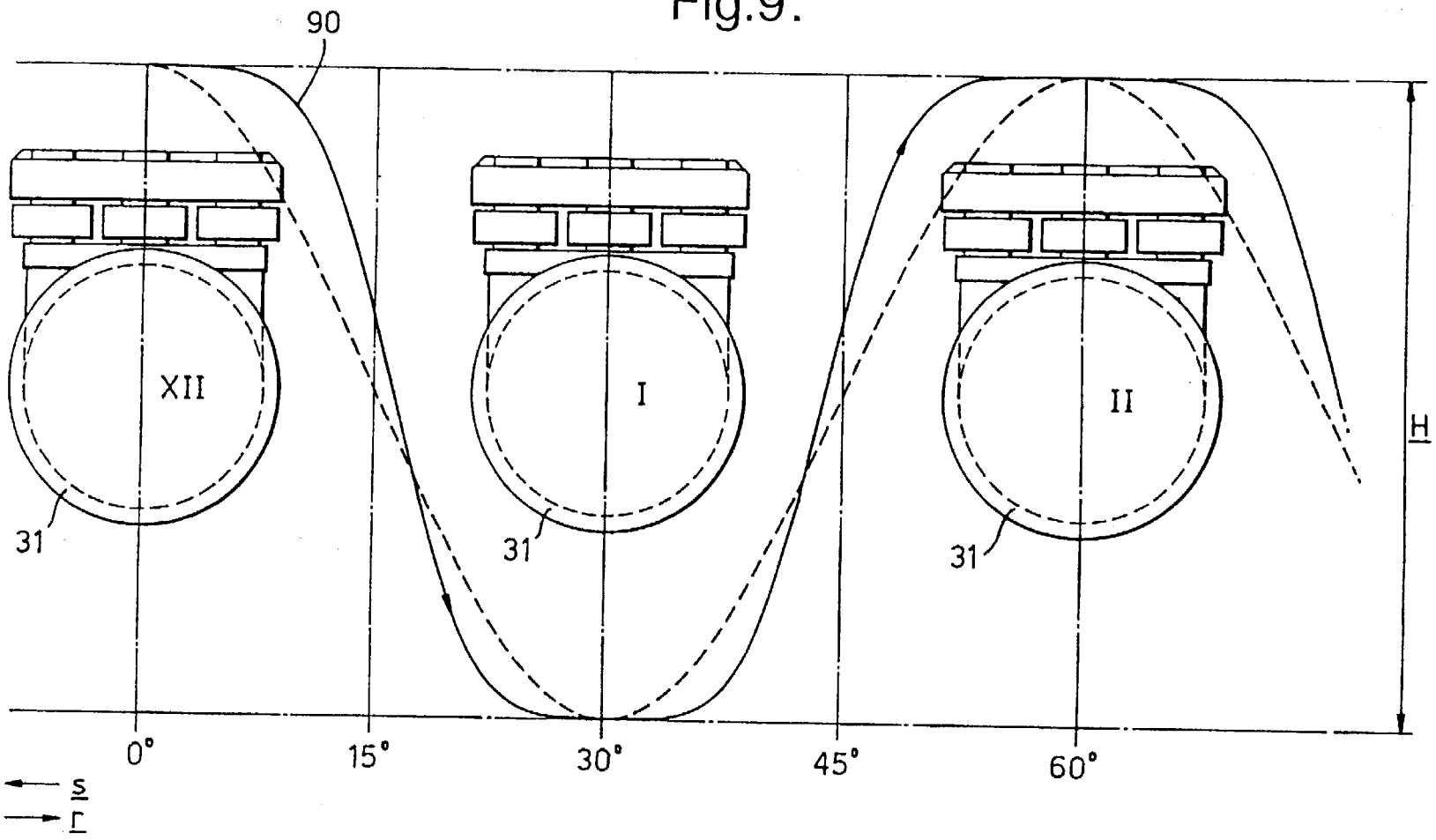
FIG. 9 is a schematic representation of the path which is traversed by the strand guide member driven by the lever according to FIG. 7 in the operation of the circular braiding machine according to FIGS. 1 and 2.

The path 90 which is followed by the strand guide member 48 (FIG. 4) during rotation of the rotor 6 in the direction of the arrow shown is represented schematically in FIG. 9, the movements of the rear and front spools 38 and 31 respectively being denoted by the arrows r and s. Since twelve of each of the spools 31 and 38 are preferably provided, their angular spacing amounts to 30° in each case. The total stroke of the strand guide member 48 is denoted H. FIG. 9 like FIG. 8 makes it clear that the major part of the stroke H is carried out fully between two spools 31, e.g. between about 10° and 25° (spools XII and I) or between about 40° and 55° (spools I and II). The result of this is that at least in the "2 over–2 under" patterns seen in FIG. 9, comparatively large spools, i.e. spools 31,38 with a large original winding diameter can be used, without risk of the crossing strands coming into undesirable contact with one another or with. parts of the machine and thereby affecting the braiding operation adversely. By choice of the eccentricity of the cam rollers 79 and the guide heads 81 the movements of the strand guide members 48 can be matched to the circumstances of a particular case and be modified relative to a pure sinusoidal movement.

A second embodiment according to the invention for the drive unit 51 of FIG. 2 will now be described with reference to FIGS. 10 to 16, where a summing drive unit is used for each drive unit 51 of FIG. 4, instead of eccentric drive units.

Figure 4:
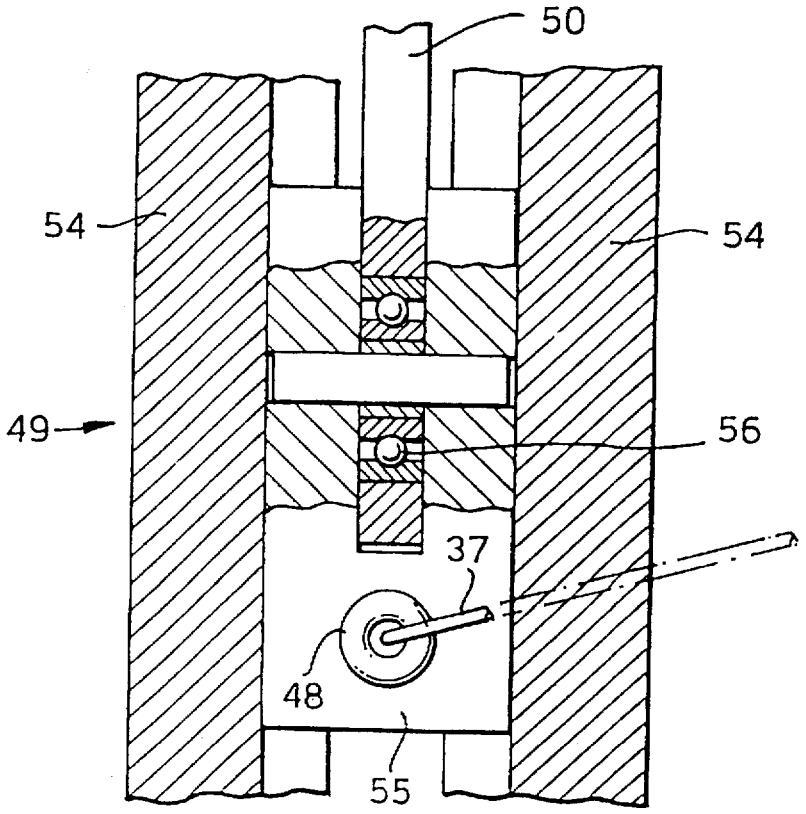
FIG. 4 is a section along the line IV—IV of FIG. 3.

Each drive unit has a drive unit housing 93 (FIGS. 10, 11), which is screwed on to the rotor 6 and which receives the drive gearwheel 58 (FIG. 11) also shown in FIGS. 4 and 5. The drive gearwheel 58 drives a shaft 95 through a gearwheel 94 fixed thereto and the shaft is mounted rotatably in the drive unit housing 93 by bearing units 96 and carries a bevel gear 97 at its end remote from the gearwheel 94. The bevel gear 97 meshes with a bevel gear 98 which is fixed by a key 99 (FIG. 12) on a shaft 100 rotatably mounted in the drive unit housing 93.

A further gearwheel 101 is fixed on the end of the shaft 100 remote from the bevel gear 97 by the same key 99 and meshes with a gearwheel 102 which, together with a further gearwheel 103, is on a shaft 104 spaced from and parallel to the shaft 100. The gearwheel 103 meshes with a gearwheel 105 which is freely rotatably mounted on the shaft 100 on the side of the gearwheel 101 facing away from the bevel gear 98. The gearwheels 101, 102, 103 and 105 are preferably spur gears. The shaft 100 and the gearwheel 105 are mounted rotatably in the drive unit housing 93 by bearing units 106 to 109 for mutual support and stable journalling.

Figure 10:
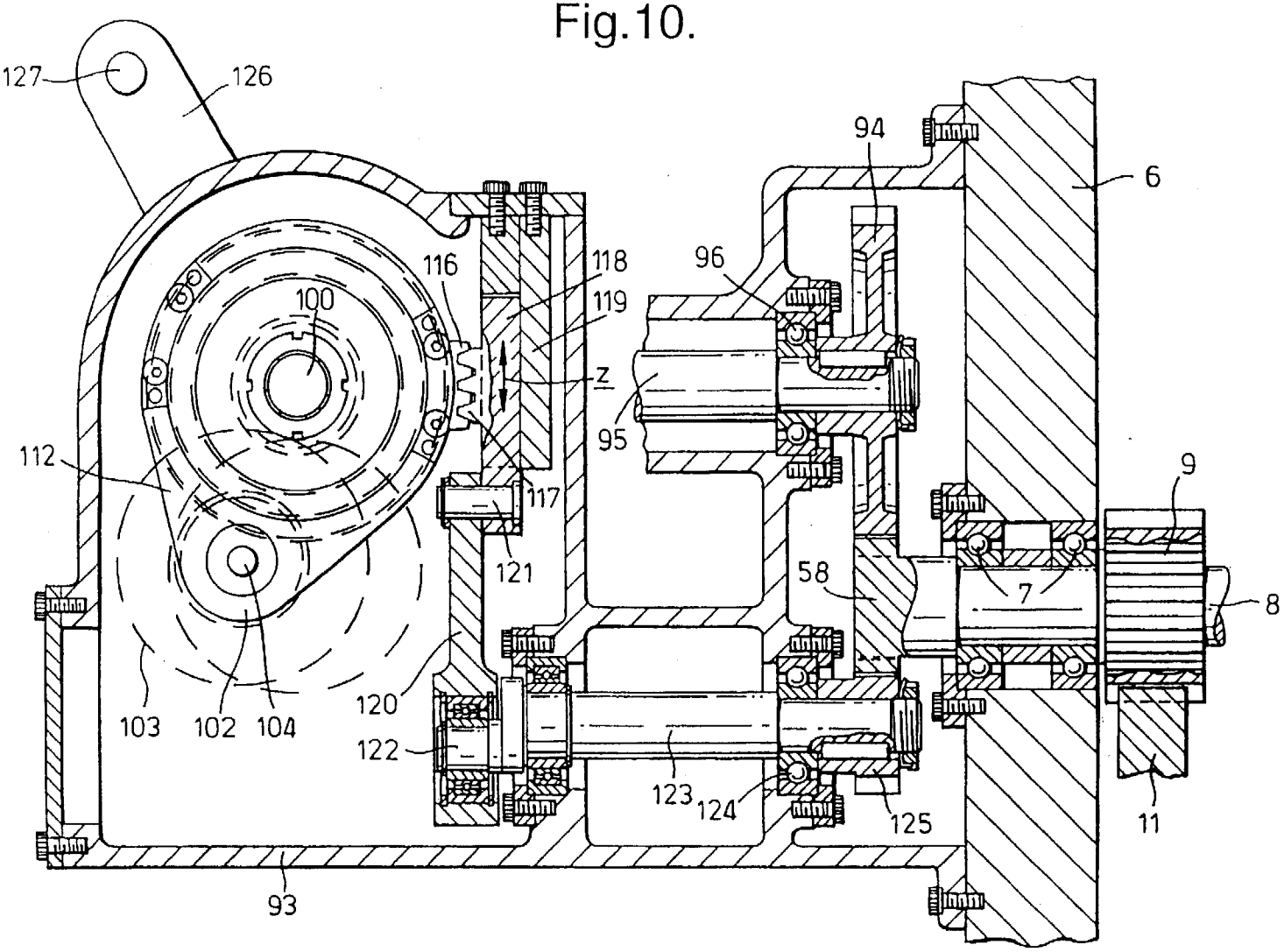
FIG. 10 is a vertical section similar to that of FIG. 2 through a second embodiment shown to a larger scale of a drive unit of the circular braiding machine according to FIGS. 1 and 2, for driving a strand guide member, along the line X—X in FIG. 12.
Figure 11:
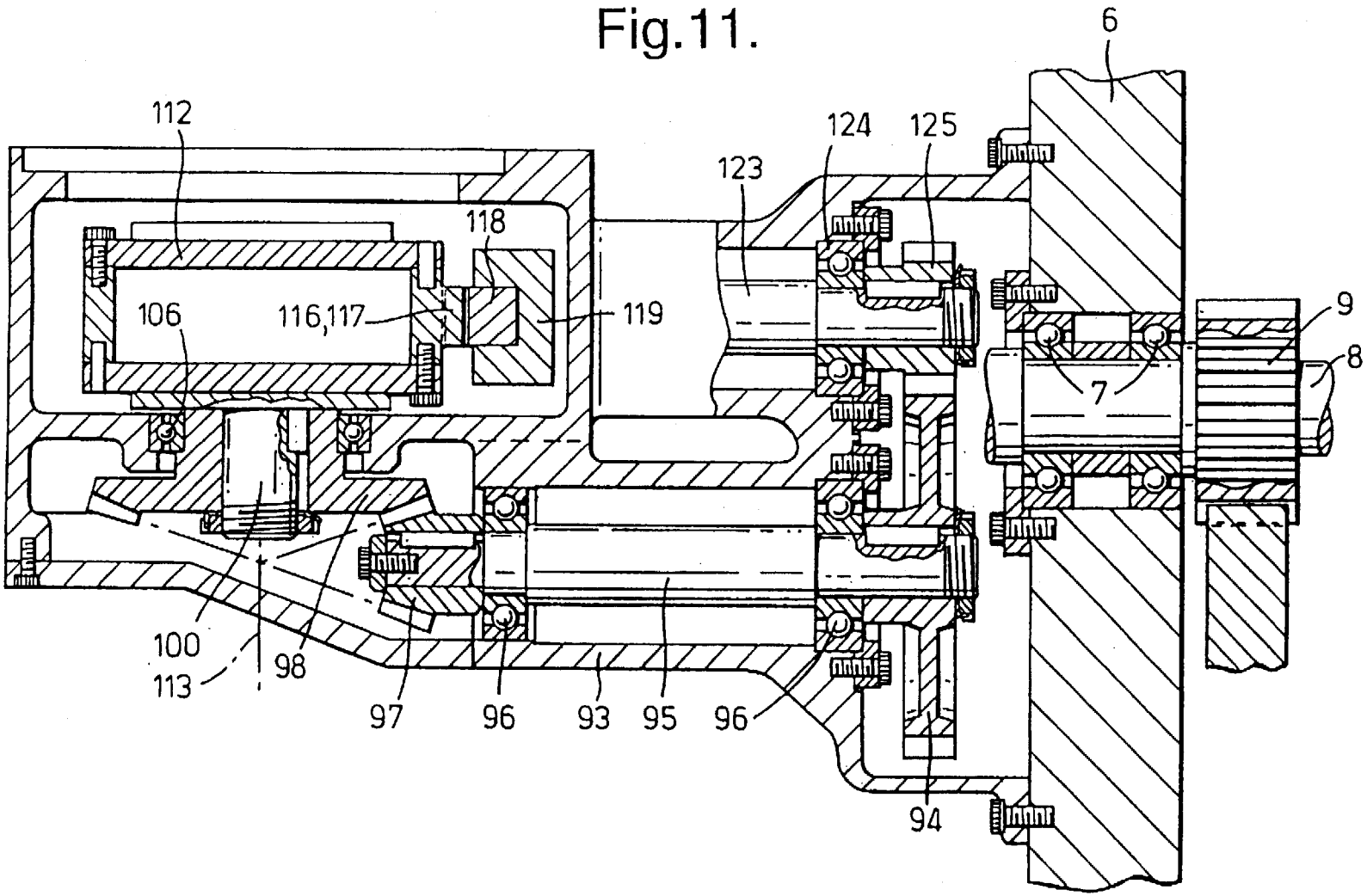
FIG. 11 is a section through the drive unit according to FIG. 10 along the line XI—XI in FIG. 12.
Figure 12:
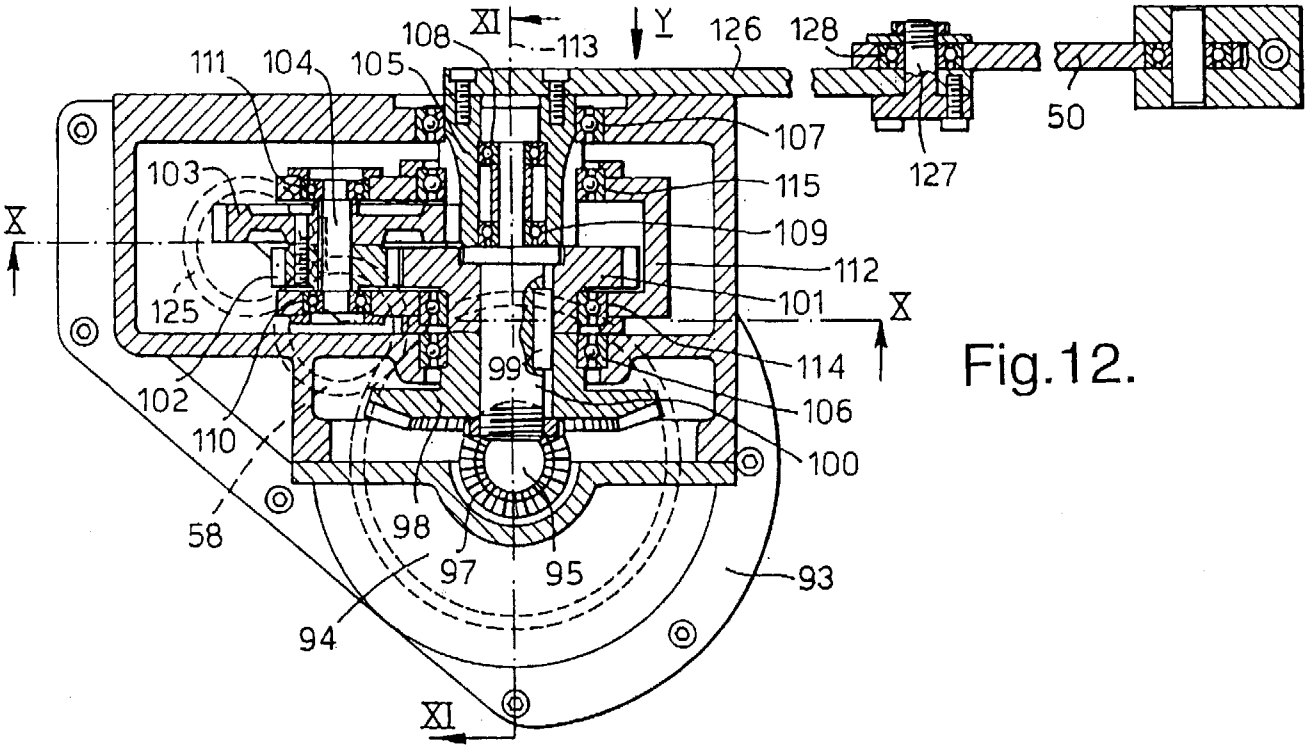
FIG. 12 is a plan view of the drive unit according to FIGS. 10 and 11.
Figure 13:
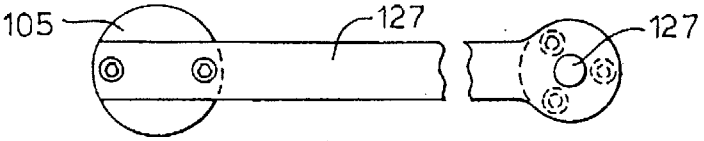
FIG. 13 is a view of a lever driven by the drive unit according to FIGS. 8 to 10 in the direction of an arrow y in FIG. 12.

According to FIGS. 10 to 12, the shaft 104 is rotatably mounted in an oscillating frame 112 by means of bearing units 110, 111, the frame for its part being rotatably mounted by means of bearing units 114 and 115 on the shaft 100 or axially extending collars of the gearwheels 98, 101 and 105 and being capable of swinging to and fro about an axis 113 (FIGS. 10, 12) of the shaft 100. The oscillating frame 112 is provided with teeth 116 on an outer wall surrounding the shaft 101 in ring manner, the teeth 116 being in engagement with teeth 117 on a rack 118 which can be moved to and fro perpendicular to the axis 113 in a guide 110 fixed in the drive unit housing 93 and in the direction of an arrow z (FIG. 11), in order thereby to turn the oscillating frame 112 and with it the shaft 104 and the gearwheels 102, 103 about the axis 113, without the engagement between the gearwheel pairs 101, 102 and 103, 105 being lost. A rod 120 acting as a connecting rod serves for the to and fro motion of the rack 118, its one end being articulated by means of a pivot pin 121 to one end of the rack 118 and its other end being fitted on an eccentric disc 112 acting as a crank and fixed eccentrically on the end of a shaft 123. The shaft 123 is mounted rotatably in the drive unit housing 93 by means of bearing units 124 and arranged with its axis perpendicular to the axis 113. A gearwheel 125 which meshes with the drive gearwheel 58 if fitted on a part of the shaft 123 remote from the eccentric disc 122.

The rear end of a crank lever 126 is fixed to the gearwheel 105 (FIGS. 12 and 13), the crank lever corresponding to the crank lever 82 according to FIGS. 6 and 7 and like that being rotatably connected by means of a bearing pin 127 and a bearing element to the lever 50 according to FIG. 4. The longitudinal axis of the crank lever 126 is correspondingly arranged perpendicular to the axis 113 and rotatable about the same.

Figure 14:
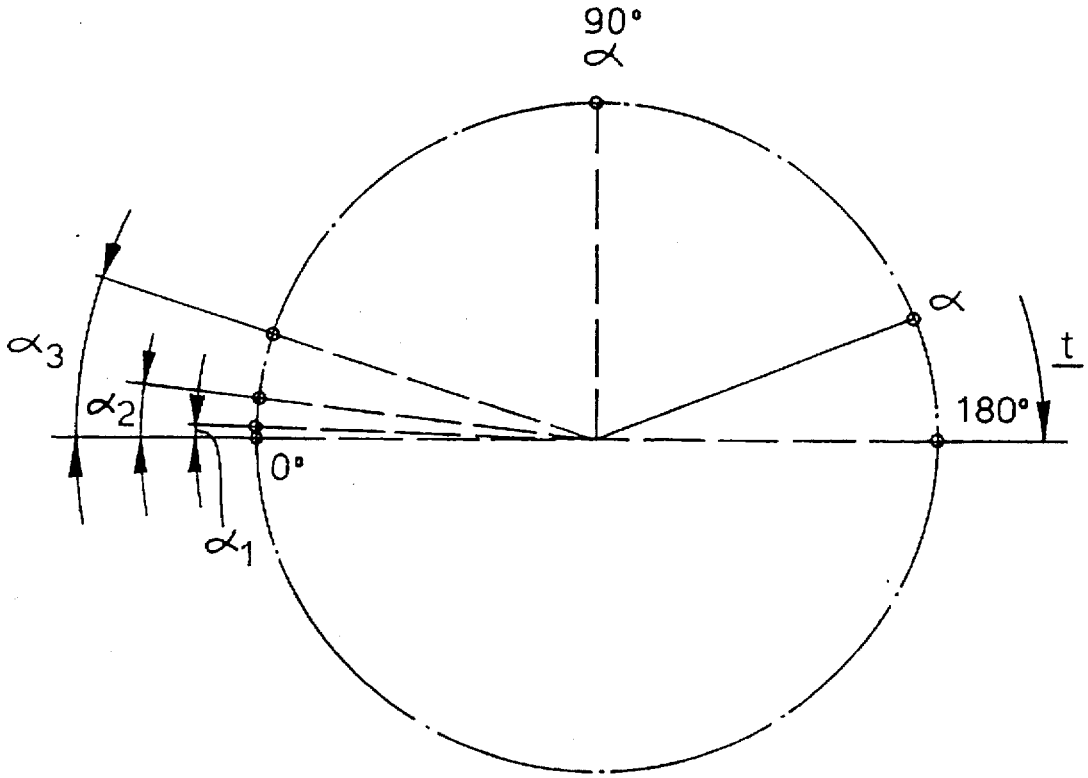
FIG. 14 is a schematic representation of the path of movement of the lever according to FIG. 13 in the operation of the circular braiding machine according to FIGS. 1 and 2.

The manner of operation of the drive unit according to FIGS. 10 to 13 is shown schematically in FIG. 14. Since the gearwheels 101 and 102 on the one hand and 103 and 105 on the other hand are in direct mesh, the gearwheel 105 turns in the same direction as the gearwheel 101 when the latter is driven through the gearwheel 94 from the drive gearwheel 58 in operation of the circular braiding machine. Since however the rack 118 is driven at the same time by the gearwheel 124 and turns the oscillating frame 112 about the axis 113 (FIGS. 10, 12) via the teeth 116, 117, the gearwheel 103 rolls on the periphery of the gearwheel 103, in dependence on the direction of movement of the rack 118 (arrow z in FIG. 11). The gearwheel 105 therefore has superimposed, in addition to the rotational movement imparted by the shaft 100, a second rotational movement in the one or the other direction, so that it turns faster or slower than corresponds to the rotational movement of the shaft 100. The same applies to the rotational movement of the crank lever 126 and the lever 50 connected thereto. All in all, as in the embodiment according to FIGS. 5 to 9, a sinusoidal movement imparted by the shaft 110 therefore has a superimposed second sinusoidal movement imparted by the rack 118, which with suitable dimensioning of the gearwheels involved again results in the strand guide member 48 moving more slowly in the regions of reversal and faster therebetween along the guide track 49 (FIG. 4), than corresponds to a pure sinusoidal movement. This is shown schematically in FIG. 14. By selection of the drive of the rack 118 the movements of the strand guide members 48 can moreover by matched to the particular case and be widely modified relative to pure sinusoidal movements.

In FIG. 14 it is assumed that the shaft 100 turns at a constant angular velocity in the direction of an arrow t. After each rotation through about 15°, 30° and 45° the gearwheel 105 (or the crank lever 126) travels overall merely through angles of rotation of $\alpha_1 \approx 2°$, $\alpha_2 \approx 7.5°$ and $\alpha_3 \approx 18°$ respectively. After rotation of the shaft 100 about a further 45° into the 90° position, the crank lever 126 also assumes the 90° position, so that it has turned substantially more in the second 45° cycle, namely through about 72°. In the next two 45° rotation of the shaft 100 the crank shaft 126 correspondingly moves through angles of firstly 72° and then 18°, so that there is again agreement in the 180° position and the strand guide member 48 assumes the right dead point of the guide track 49 in FIG. 2. With further rotation through 180° the same process takes place until in the 0° position all parts have again assumed the starting position and the strand guide member 48 assumes the left dead point position in FIG. 2.

Figure 15:
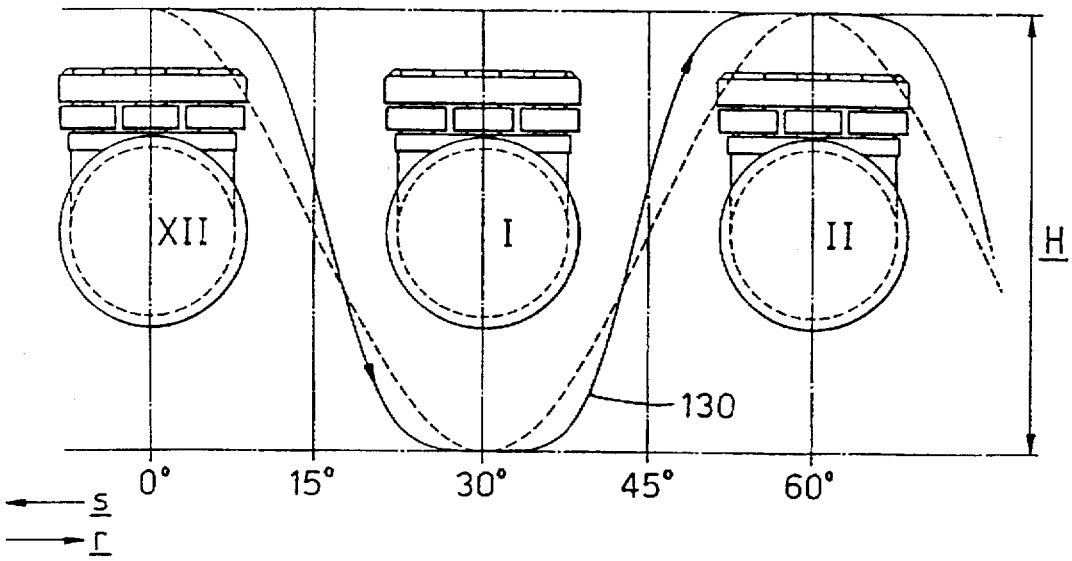
FIGS. 15 and 16 are schematic views of the paths for the strand guide member which can be obtained with different designs of the drive unit according to FIGS. 10 to 12 in operation of the circular braiding machine according to FIGS. 1 and 2.

The path 130 which is described by the strand guide member 48 in the direction of the indicated arrow with rotation of the rotor 6 is shown in FIG. 15. This path 130 corresponds largely to the path 90 according to FIG. 9 and thus leads to the same advantages as this. In contrast to FIG. 9 however, the path 130 runs somewhat flatter in the regions of reversal than the path 90. A pure sinusoidal curve is indicated in broken lines as in FIG. 9 for comparison.

Figure 16:
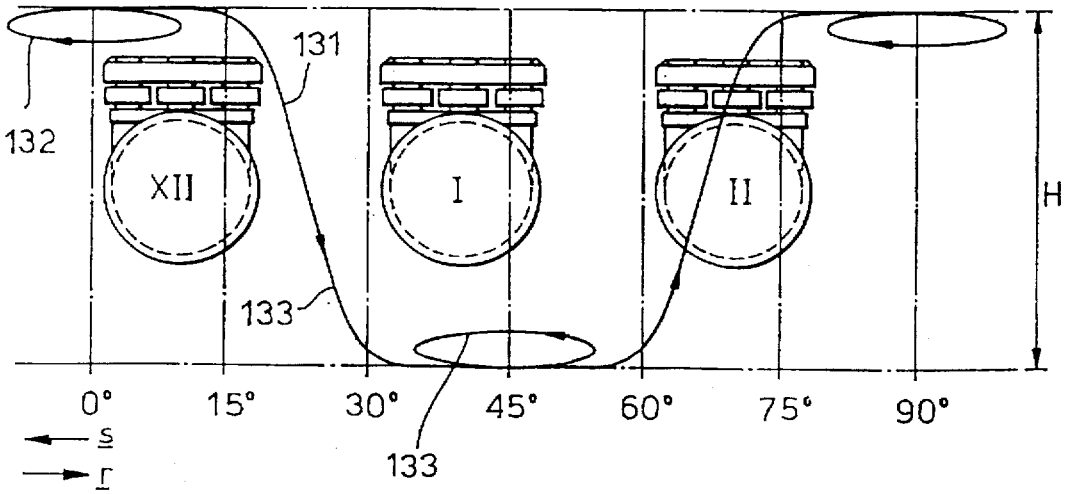

Depending on the transmission ratios of the gearwheels involved and the drive of the rack 118 it is even possible with the embodiment according to FIGS. 10 to 12 for the gearwheel 105 to run briefly in the opposite direction to the shaft 100, i.e. its angular velocity can become negative. This is indicated schematically in FIG. 16 for a path 131, which is described by the strand guide members 48 in the direction of the indicated arrow. In contrast to FIGS. 9 and 15 the strand guide members 48 here lead in the regions of reversal of the path 130 not only to a retarded movement but even to a reciprocating movement along a wait loop 132 or 133 with a small stroke. This makes it possible for the strand guide members 48 to dwell for a selected dwell time in the regions of reversal before the next crossover operation is effected. An advantage of this measure lies in the dwell time, as FIG. 16 shows, can be made so long that "3 under–3 over" patterns are possible, without the steep curve sections of the track having to be abandoned in the crossover regions.

The invention is not limited to the described embodiments, which can be modified in many ways. This applies especially to the means which are used in a particular case to realise the eccentric or summing drive unit or any other equivalent drive unit. It would also be possible to effect the to and fro movement of the strand guide member 48 48 and/or of the oscillating frame 112 with other than the means shown. Also the circular braiding machine described with reference to FIGS. 1 and 2 only represents an example, since the described embodiments for the drive unit could basically be used with suitable modification of the overall construction for all circular braiding machines, including those with a vertical axis, which are provided with reciprocating strand guide members for producing the necessary crossovers.

It will be understood that each of the elements described above, or two or more together, may also find a useful application in other types of constructions differing from the types described above.

While the invention has been illustrated and described as embodied in an arrangement with a braiding machine of the high-speed braiding principle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

I claim:

1. A circular braiding machine, comprising: an axis of rotation (1); a group each of inner and outer spools (31, 38) arranged on a circular track coaxial with the axis of rotation (1) and each carrying a strand (32, 37); drive means (9–11, 17, 29, 42–45) for moving the groups of spools in opposite directions (r,s) around the circular track; strand guide members (48) for guiding at least the strands (37) of one of the groups of spools (38) at a location between the latter and a braiding point (35), said strand guide members (48) being mounted to reciprocate in guide tracks (49) arranged with such an angle relative to the axis of rotation (1) that the distance of the strand guide member (48) from the braiding point (35) is substantially constant during the whole path of movement; rotating crank levers (82, 126) provided in the drive means; and means operating synchronously with said drive means, being coupled to said strand guide members (48) for crossing the strands (32, 37) of the inner and outer spools (31, 38) and having levers (50), said levers (50) being arranged substantially in the extension of said guide tracks (49) and being articulated in the manner of connecting rods to one end to said strand guide members (48) and at the other end to respective ones of said rotating crank levers (82, 126).

2. A circular braiding machine according to claim 1, characterized in that said guide tracks (49) are formed by spaced rails (54), between which a carriage (55) with one of said strand guide members (48) is movably guided.

3. A circular braiding machine according to claim 1 and further comprising at least one drive unit (51) for driving a respective one of said crank levers (82, 126), said drive unit (51) creating a superimposed sinusoidal movement such that the angular velocity of the respective crank lever (82, 126) at the regions corresponding to the points of reversal of the guide track (49) and at the regions lying therebetween are respectively smaller than and greater than that which corresponds to a pure sinusoidal circulating movement.

4. A circular braiding machine according to claim 3, characterized in that said drive unit (51) is an eccentric drive unit.

5. A circular braiding machine according to claim 4, characterized in that said eccentric drive unit has two eccentrics rotatable in opposite senses, of which one projects into a slot (83) and the other into a circular opening (84) in the respective crank lever (82).

6. A circular braiding machine according to claim 5, characterized in that said one eccentric is formed as a cam roller (79) and said other eccentric is formed as a guide head (81).

7. A circular braiding machine according to claim 5, characterized in that said two eccentrics are mounted to rotate with the same absolute angular velocity.

8. A circular braiding machine according to claim 3, characterized in that said drive unit (51) is a summing drive unit.

9. A circular braiding machine according to claim 8, characterized in that said summing drive unit has for providing a first movement a rotating shaft (100) which drives the respective crank lever (126) and which is driven synchronously with the movement of the groups of spools (31, 38), and in that means are provided to superimpose a second movement on said first movement.

10. A circular braiding machine according to claim 9, characterized in that said superimposing means comprise a wheel (105) which is mounted to be freely rotatable and is driven by said shaft (100), with its angular velocity increasable or reduceable by the means in dependence on the angular position of said respective crank lever (126).

11. A circular braiding machine according to claim 10, further comprising an oscillating frame (112) which swings to and fro and which is rotatably mounted on the wheel (105), and transmission wheels (102, 103) being mounted in the frame and drivably connected to the wheel (105) and the shaft (100), wherein at least one of said transmission wheels (102, 103) rolls on the wheel (105) in the one or other sense of rotation as the oscillating frame (112) swings.

12. A circular braiding machine according to claim 11, characterized in that the wheel (105) and the shaft (100) are arranged coaxially and the transmission wheels (102, 103) are fixed on a shaft (104) arranged spaced from and parallel to the shaft (100) and mounted rotatably in the oscillating frame (112).

13. A circular braiding machine according to claim 11, characterized in that the wheel (105) and the transmission wheels (102, 103) are gearwheels.

14. A circular braiding machine according to claim 11, characterized in that said oscillating frame (112) has teeth (116) in mesh with a rack (118) and the rack (118) is connected to a crank drive (120–123) coupled synchronously to the drive means.

15. A circular braiding machine according to claim 14, characterized in that the waiting loops (132, 133) are set up with the aid of the oscillating frame (112) and the crank drive (120–123) for the rack (118).

16. A circular braiding machine according to claim 1, characterized in that said guide tracks (49) are of linear form.

17. A circular braiding machine according to claim 1, characterized in that said guide tracks are arranged on such an arc that the strand guide members (48) are guided at a constant distance from the braiding point (35).

18. A circular braiding machine according to claim 1, characterized in that the means coupled to said strand guide members (48) for crossing the strands (31, 37) are so formed that the strand guide members pass through a waiting loop (132, 133) in the regions of reversal of the guide tracks (49).

* * * * *